US010204497B1

(12) United States Patent
Yu

(10) Patent No.: US 10,204,497 B1
(45) Date of Patent: Feb. 12, 2019

(54) ALARM NOTIFICATION SYSTEM

(71) Applicant: Chao-Cheng Yu, Taoyuan (TW)

(72) Inventor: Chao-Cheng Yu, Taoyuan (TW)

( * ) Notice: Subject to any disclaimer, the term of this patent is extended or adjusted under 35 U.S.C. 154(b) by 0 days.

(21) Appl. No.: 16/019,619

(22) Filed: Jun. 27, 2018

(51) Int. Cl.

| | |
|---|---|
| ***G08B 3/10*** | (2006.01) |
| ***G08B 13/24*** | (2006.01) |
| ***G08B 25/10*** | (2006.01) |
| ***G08C 17/02*** | (2006.01) |

(52) U.S. Cl.
CPC ..... *G08B 13/2468* (2013.01); *G08B 3/10* (2013.01); *G08B 13/2405* (2013.01); *G08B 25/10* (2013.01); *G08C 17/02* (2013.01)

(58) Field of Classification Search
CPC ..... G08B 13/2462; G08B 13/2402; G08B 13/2434; G08B 13/248; G08B 13/2482; G08B 13/1427; G08B 13/2451; G08B 13/2417
USPC ..... 340/572.1
See application file for complete search history.

(56) References Cited

U.S. PATENT DOCUMENTS

| | | | | |
|---|---|---|---|---|
| 8,064,412 | B2 * | 11/2011 | Petite | H04L 12/2825 340/540 |
| 8,350,694 | B1 * | 1/2013 | Trundle | G08B 25/08 340/539.11 |
| 9,111,431 | B2 * | 8/2015 | Wu | G08B 25/001 |
| 9,129,497 | B2 * | 9/2015 | Petite | G01V 1/364 |
| 9,384,652 | B2 * | 7/2016 | Gilham | A61B 5/746 |

* cited by examiner

*Primary Examiner* — Mark S Blouin
(74) *Attorney, Agent, or Firm* — WPAT, PC

(57) ABSTRACT

An alarm notification system is herein disclosed, which allows to pair a portable alarm device with the pairing software in a smart device such that the portable alarm device is able to turn on the wireless transmission function and connect to a server appliance, and since the alarm central control device is connected to the server appliance, an alarm detection device and an anti-theft device, in case that the alarm detection device detects any abnormal event and generate an alarm notification signal, the generated signal can be transferred to the portable alarm device via the server appliance, and then it is possible to choose to press down a button on the portable alarm device in order to generate a report control signal which can be sent to the alarm central control device by way of the server appliance, thus that the alarm central control device may control the operation of the anti-theft device in accordance with the received report control signal.

10 Claims, 8 Drawing Sheets

ALARM NOTIFICATION SYSTEM

BACKGROUND OF THE INVENTION

1. Field of the Invention

The present invention generally relates to an alarm notification system; more specifically, the present invention allows a portable alarm device to receive an alarm notification signal, and then it is possible to directly operate the portable alarm device so as to generate a report control signal and transfer the signal to the alarm central control device which can subsequently control the operation of the anti-theft device based on the received report control signal.

2. Description of Related Art

With the evolution of the times and the development of the society, home safety is an important part of modern people. In order to ensure the safety of homes or companies, users mostly often install a certain type of security system at their home or company In order to monitor the state of the environment at any time thereby enhancing safety quality as well as protecting personal security. As a result, security systems are now generally set up at home. In case that the security system does detect the occurrence of some abnormal situations, it will report it back to the service center thereof immediately; at this time, the service center administrators may dispatch available external service personnel to arrive at the targeted sites for confirming such occurrence of the abnormal situations.

However, upon encountering natural disasters or certain sudden incidents, the service center administrators may be unable to perform normal service scheduling within a short period of time; therefore, emergency events could not be effectively handled or eliminated in a short time. As such, emergency events may be resolved in a more efficient way if it is possible to autonomously receive alarm or siren signals and then perform preliminary processes. However, since existing alarms usually do not have Internet connection or wireless signal transmission functions, suppose all sensors or alarms are to be able transfer the signals indicating such detected abnormal conditions via wireless networks and Internet transmissions to a remote server or mobile device, the old sensors or alarms installed at home are inevitably all required to be replaced with advanced, high-leveled sensors or alarms featuring wireless communication or Internet connection functions. But, it should be understood that such replacements or alternations of all existing, old sensors or alarms may be quite costly and thus become a heavy burden for the users.

Accordingly, as previously explained and subsequently illustrated in the present invention, it would be an optimal solution if it is possible to allow to set up an alarm central control device having the networking feature at home, which can receive signals coming from a sensor or a buzzer, and also transfer signals to a server appliance and then further to a portable alarm device by means of the external server, such that the user is capable of receiving alarm information and also pressing down the button on the portable alarm device thereby generating a signal to be sent back to the alarm central control device by way of the server appliance thus letting the alarm central device control the enabling operation of an anti-theft device.

SUMMARY OF THE INVENTION

An alarm notification system is disclosed, comprising: a server appliance; an alarm central control device, connected to the service appliance, one or more alarm detection devices and at least one anti-theft device, and including: a central control controller unit, used to control the operation of the alarm central control device; a network connection unit, electrically connected to the central control controller unit in order to connect to the Internet such that the central control controller unit can transfer an alarm notification signal to the server appliance, or receive a report control signal sent by the server appliance thus that the central control controller unit can control the operation of the anti-theft device based on the received report control signal; an intelligent device, including: a hotspot sharing unit, used to open and provide at least a Wi-Fi hotspot having a connection name and a connection password; a pairing software, capable of connecting to the hotspot sharing unit so as to, after receiving a connection signal, send out the connection name and the connection password of the Wi-Fi hotspot; a portable alarm device, including: a power source voltage regulator unit, used to provide required electric power for the operation of the portable alarm device; an alarm control unit, electrically connected to the power source voltage regulator unit so as to control the operation of the portable alarm device, and further allowing to detect the operation condition in the portable alarm device; a pairing unit, electrically connected to the alarm control unit and the power source voltage regulator unit and capable of transferring the connection signal to be received by the pairing software in the intelligent device, such that the pairing software can further transfer the connection name and the connection password of the Wi-Fi hotspot to the pairing unit; a wireless transmission unit, electrically connected to the alarm control unit and the power source voltage regulator unit and capable of enabling the wireless transmission function with the above-said connection name and connection password of the Wi-Fi hotspot thereby connecting to the Internet; also, the wireless transmission unit can receive the alarm notification signal transferred by the server appliance and then transfer to the alarm control unit in the portable alarm device, or alternatively, the alarm control unit in the portable alarm device can generate the report control signal which can be transferred to the server appliance by means of the wireless transmission unit; a wireless status display unit, electrically connected to the alarm control unit and the power source voltage regulator unit for displaying the operation condition in the wireless transmission unit; an alarm notification display unit, electrically connected to the alarm control unit and the power source voltage regulator unit and used for displaying after the alarm control unit receiving the alarm notification signal; an acoustic output unit, electrically connected to the alarm control unit and the power source voltage regulator unit and used for generating the audio signal after the alarm control unit receiving the alarm notification signal; a system status display unit, electrically connected to the alarm control unit and the power source voltage regulator unit and used for displaying the operation condition in the portable alarm device after the alarm control unit having detected the operation condition in the portable alarm device; a reset button unit, electrically connected to the alarm control unit and the power source voltage regulator unit and used for pressing down thereby configuring the pairing connection with the portable alarm device; and one or more control button units, electrically connected to the alarm control unit and the power source voltage regulator unit and used for pressing down thereby controlling the operation of the alarm control unit.

More specifically, the above-said alarm detection device is a siren or a sensor.

More specifically, the above-said anti-theft device is a camera, a microphone and/or a remote alarm device.

More specifically, the above-said intelligent device is a smartphone or a tablet computer.

More specifically, after the above-said reset button unit being pressed down, the alarm control unit controls the pairing unit to transfer the connection signal and receives the connection name and the connection password of the Wi-Fi hotspot such that the wireless transmission unit can start the wireless transmission function with the connection name and the connection password of the Wi-Fi hotspot and connect to the server appliance.

More specifically, the above-said alarm control unit can set up the pressdown modes of the control button unit and control the operation of the alarm control unit in accordance with such different pressdown modes.

More specifically, the above-said alarm control unit can be configured to, after receiving the alarm notification signal, automatically start the alarm notification display unit and/or the acoustic output unit.

More specifically, the above-said alarm control unit can be configured such that, after receiving the alarm notification signal, the alarm control unit can start the alarm notification display unit and/or the acoustic output unit only when the control button unit is pressed down.

More specifically, the above-said wireless status display unit, the alarm notification display unit and the system status display unit are Light-Emitting Diodes (LEDs).

More specifically, the above-said acoustic output unit is a buzzer or a speaker.

More specifically, the above-said power source voltage regulator unit can be a battery or a regulator circuit, and the regulator circuit can be further connected to an external power source.

DETAILED DESCRIPTION OF THE PREFERRED EMBODIMENTS

Other technical contents, aspects and effects in relation to the present invention can be clearly appreciated through the detailed descriptions concerning the preferred embodiments of the present invention in conjunction with the appended drawings.

Figure 1:
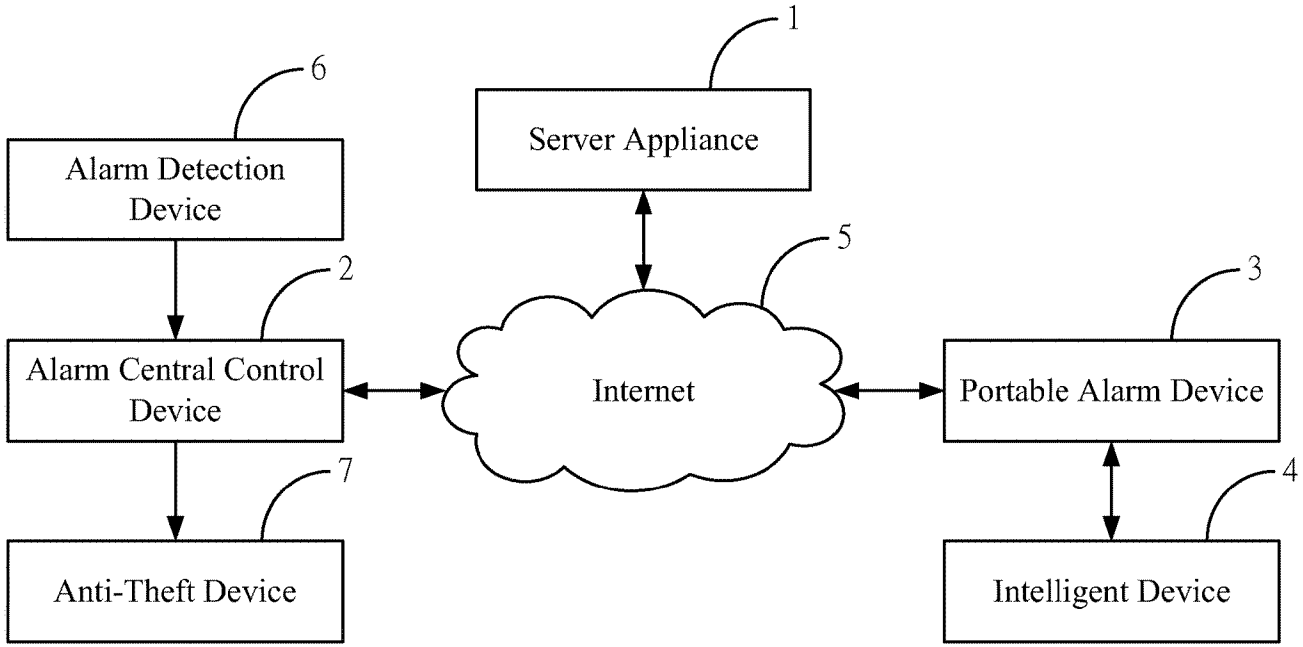
FIG. 1 shows an overall architecture diagram for the alarm notification system according to the present invention.
Figure 2:
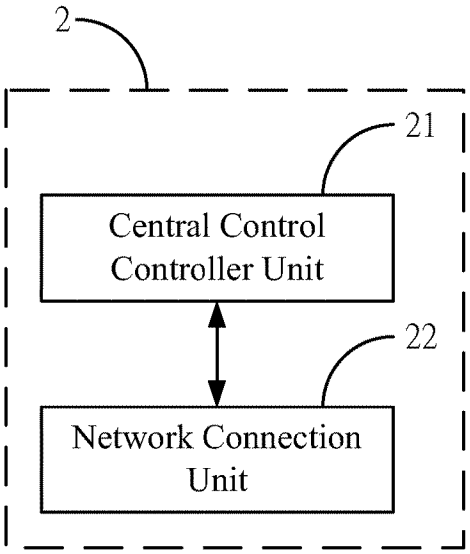
FIG. 2 shows an architecture diagram for the alarm central control device in the alarm notification system according to the present invention.

Refer initially to FIGS. 1-2, wherein an overall architecture diagram and the alarm central control device for/in the alarm notification system according to the present invention are respectively shown. It can be seen from the Figures that the illustrated alarm notification system comprises a server appliance 1, an alarm central control device 2, a portable alarm device 3 and an intelligent device 4, wherein the alarm central control device 2 can be connected to the server appliance 1, one or more alarm detection devices 6 as well as at least one anti-theft device 7.

Herein the alarm detection devices 6 may be anti-theft alarms, infrared alarms or door and window sirens, smoke sensors, central controllers for a security system or gas sensors, etc.; in other words, any type of security sensing device or warning apparatus installed at home, office or elsewhere can be applied as an alarm device to be detected by the present invention, while the anti-theft device 7 may be a camera, a microphone and/or a remote alarm device.

In addition, the alarm central control device 2 includes a central control controller unit 21 and a network connection unit 22, in which the central control controller unit 21 is used to control the operation of the alarm central control device 2 and further store the network address or IP address of the server appliance 1, so that, after the network connection unit 22 having connected to the Internet 5, the central control controller unit 21 can transfer an alarm notification signal to the server appliance 1, or reversely receive a report control signal sent by the server appliance 1. Accordingly, the central control controller unit 21 can control the operation in the anti-theft device 7 based on the received report control signal.

Figure 3A:
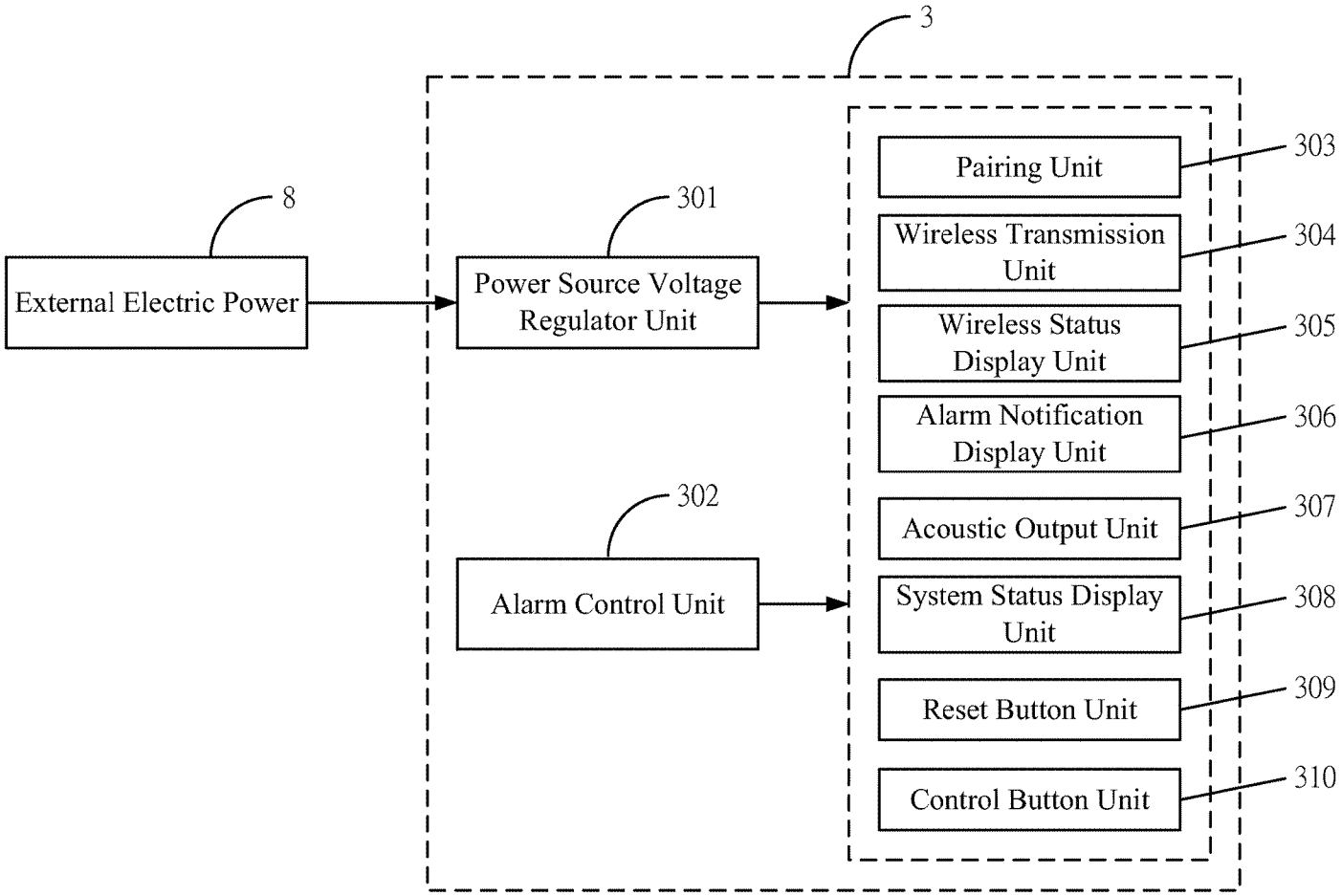
FIG. 3A shows an architecture diagram for the portable alarm device in the alarm notification system according to the present invention.
Figure 3B:
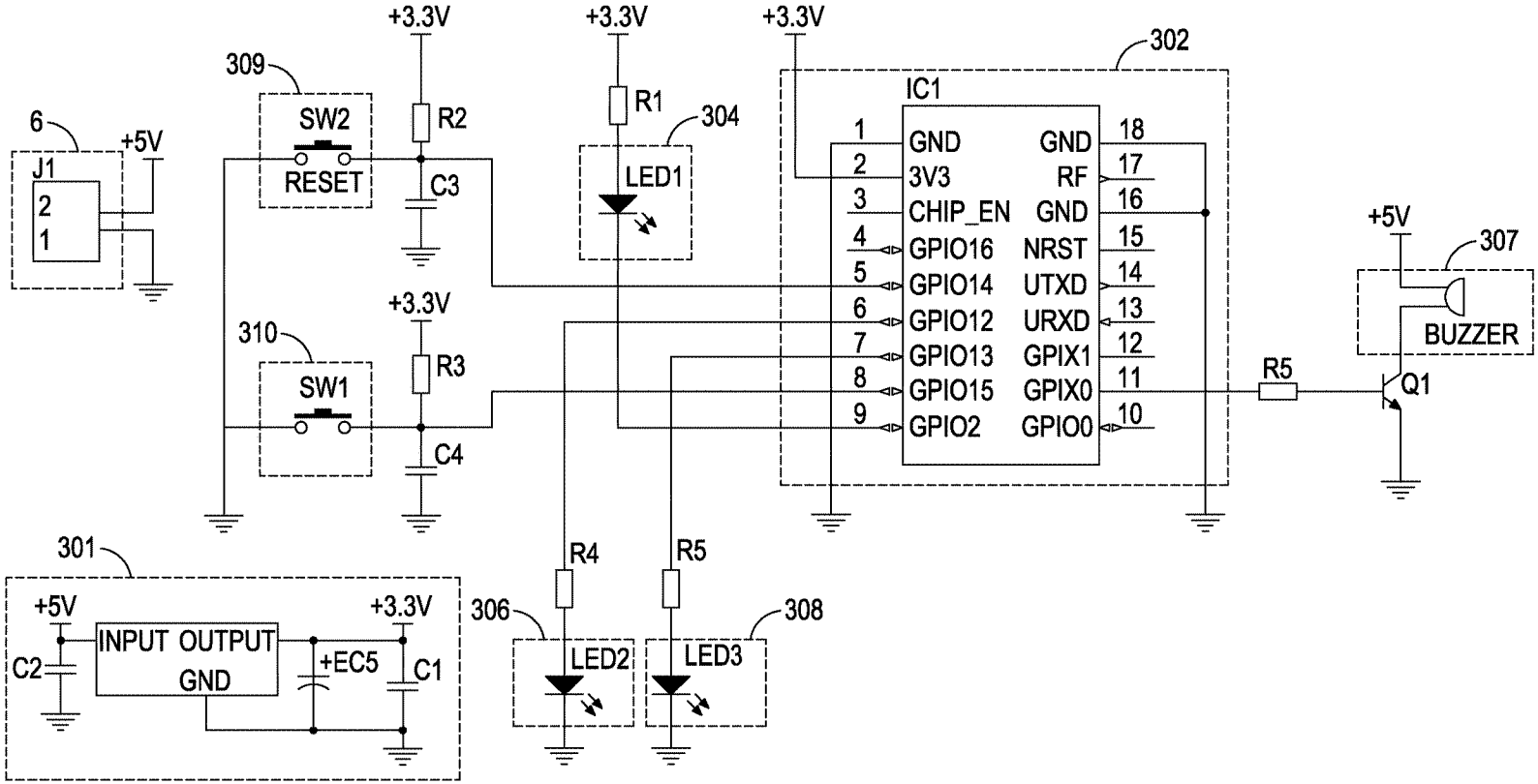
FIG. 3B shows a circuit diagram for the portable alarm device in the alarm notification system according to the present invention.

Moreover, as shown in FIGS. 3A and 3B, the portable alarm device 3 includes a power source voltage regulator unit 301, an alarm control unit 302, a pairing unit 303, a wireless transmission unit 304, a wireless status display unit 305, an alarm notification display unit 306, an acoustic output unit 307, a system status display unit 308, a reset button unit 309, one or more control button units 310, in which the power source voltage regulator unit 301 is used to provide the electric power required by the operation in the portable alarm device 3, and can be a battery or a voltage regulator circuit and possibly further connected an external power source 8.

Besides, in addition to controlling the operation of the portable alarm device 3, the alarm control unit 302 can further store the network address or IP address of the server appliance, and detect the operation condition in the portable alarm device 3 as well.

Figure 4:
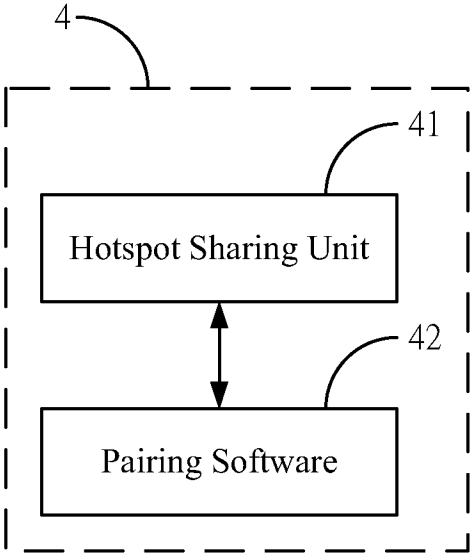
FIG. 4 shows an architecture diagram for the intelligent device in the alarm notification system according to the present invention.

Additionally, as shown in FIG. 4, the intelligent device 4 may be a smartphone or a tablet computer, and includes a hotspot sharing unit 41 and a pairing software 42, in which the hotspot sharing unit 41 can be use to initiate and provide at least a Wi-Fi hotspot having a connection name and a connection password, while the pairing software 42 can, after receiving a connection signal, transfer the connection name and the connection password of the Wi-Fi hotspot such that the pairing unit 303 can send out a connection signal to be received by the pairing software 42 in the intelligent device 4, and the pairing software 42 then accordingly transfers the previously received connection name and connection password of the Wi-Fi hotspot back to the pairing unit 303.

Subsequently, the wireless transmission unit 304 can start the wireless transmission function with the received connection name and the connection password of the Wi-Fi hotspot and connect to the Internet 5, and also receive the alarm notification signal sent by the server appliance 1 and transfer the received signal to the alarm control unit 302; or alternatively, the alarm control unit 302 may generate a report control signal which can be transferred to the server appliance 1 via the wireless transmission unit 304.

After the wireless transmission unit 304 starting the wireless transmission function with the connection name and the connection password of the Wi-Fi hotspot, the wireless status display unit 305 (e.g., LEDs) can indicate the operation conditions (e.g., a normal status or abnormal status) in the wireless transmission unit 304.

Furthermore, after the wireless transmission unit 304 receiving the alarm notification signal sent by the server appliance 1 and transferring to the alarm control unit 302, the alarm notification display unit 306 (LEDs) can exhibit twinkling indications, and the acoustic output unit 307 (e.g., a buzzer or a speaker) may also additionally generate audio signals.

Besides, upon detecting the operation condition in the portable alarm device 3 by the alarm control unit 302, it is possible to display the status of the portable alarm device 3 by means of the system status display unit 308 (e.g., LEDs).

Moreover, after the reset button unit 309 being pressed down, the alarm control unit 302 controls the pairing unit 303 to transfer the connection signal and receives the connection name and the connection password of the Wi-Fi hotspot such that the wireless transmission unit 304 can start the wireless transmission function with the connection name and the connection password of the Wi-Fi hotspot and connect to the server appliance 1.

In addition, the alarm control unit 302 can set up the pressdown modes of the control button unit 310 and control the operation of the alarm control unit 302 in accordance with such different pressdown modes. Also, the alarm control unit 302 can be configured so as to, after receiving the alarm notification signal, automatically initiate the alarm notification display unit 306 and/or the acoustic output unit 307; or otherwise, the alarm control unit 302 can be configured so that, after receiving the alarm notification signal, the control button unit 310 needs to be pressed down first thereby then allowing the alarm control unit 302 to start the alarm notification display unit 306 and/or the acoustic output unit 307.

Figure 5A:
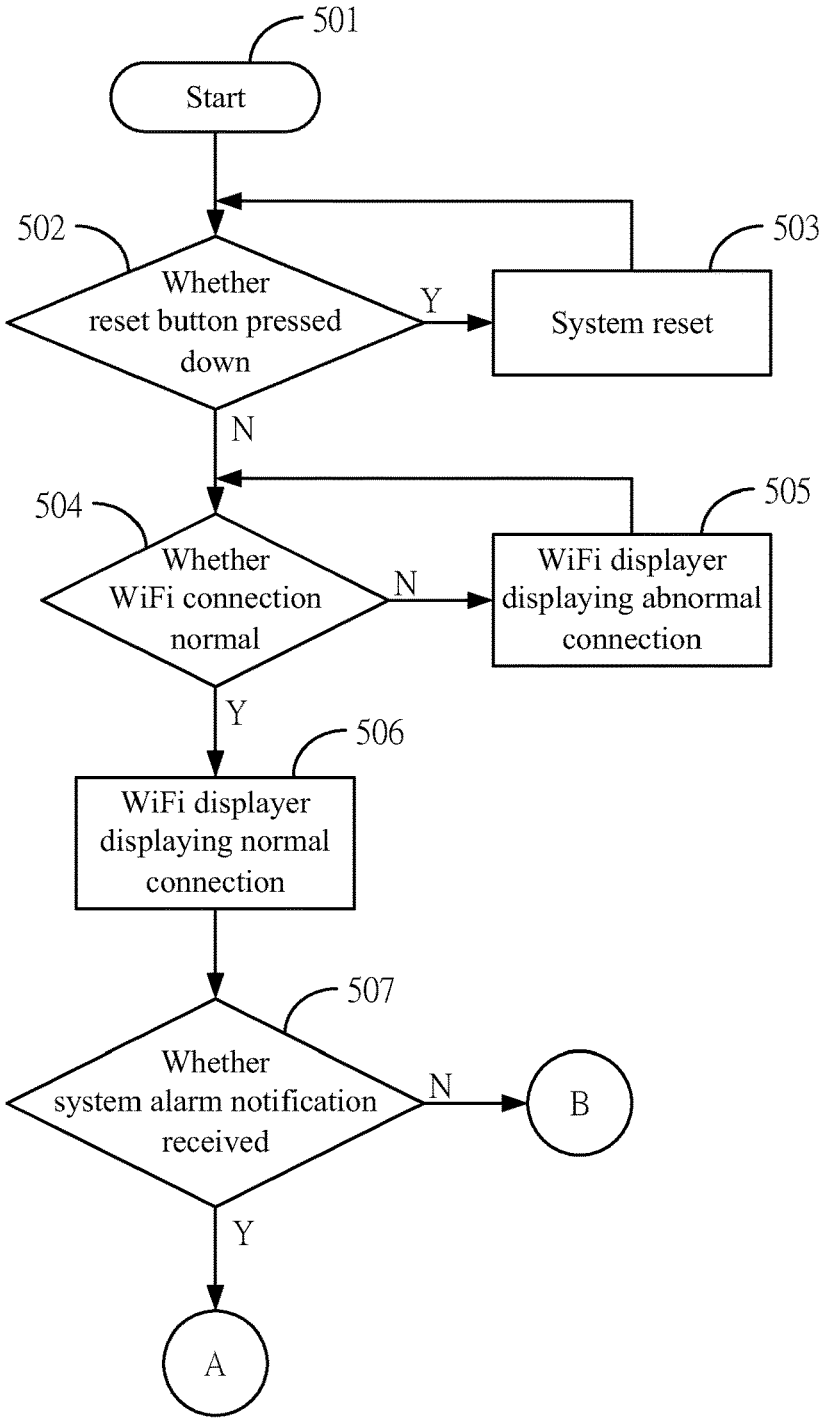
FIG. 5A shows an operation flowchart for the alarm notification system according to the present invention.
Figure 5B:
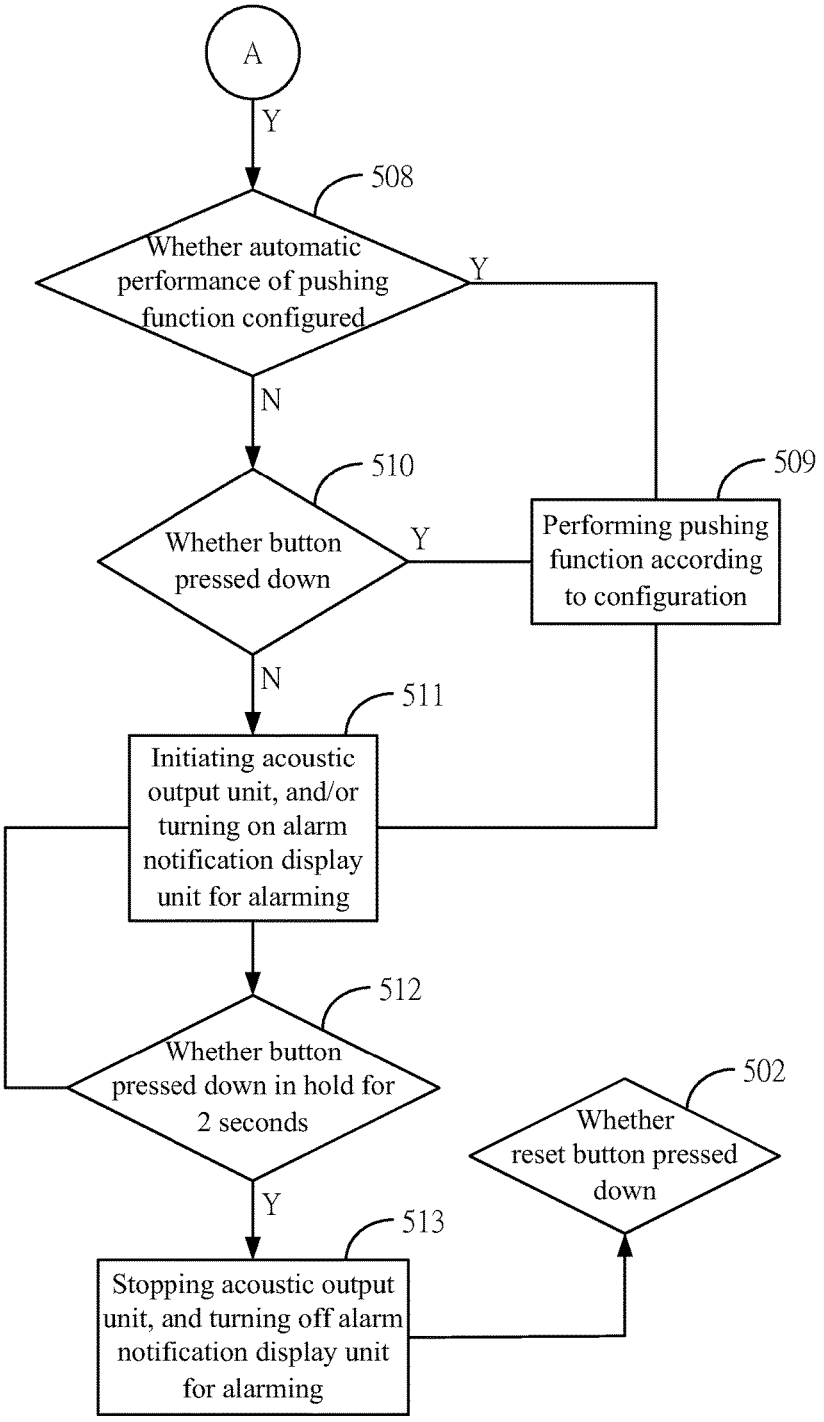
FIG. 5B shows another operation flowchart for the alarm notification system according to the present invention.
Figure 5C:
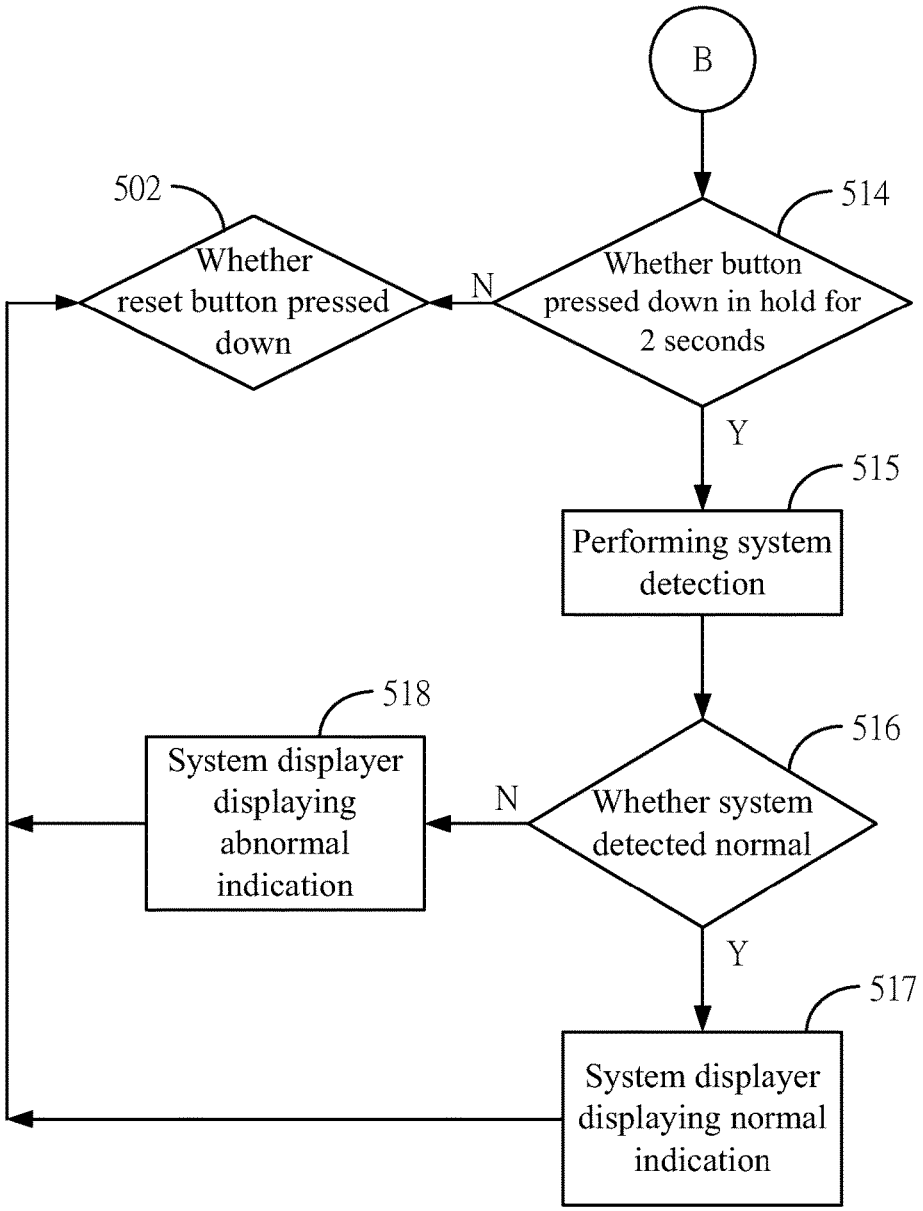
FIG. 5C shows yet another operation flowchart for the alarm notification system according to the present invention.

The operation flowcharts for the alarm notification system according to the present invention are respectively shown in FIGS. 5A-5C, explained as below:

(1) Starting operation (501); then detecting whether the reset button unit is pressed down (502); if determined to be YES, performing the system reset (503); if determined to be NO, determining whether the Wi-Fi connection is normal (504);

(2) in case of determining to be an abnormal connection, displaying an abnormal light indication via the wireless status display unit (505); if determined to be a normal connection, displaying a normal light indication by the wireless status display unit (506);

(3) afterwards, determining whether the system alarm notification signal is received (507); if YES, then further determining whether the alarm control unit is configured to automatically perform a pushing operation (508); if determined to be YES, then pushing the alarm notification signal to the portable alarm device (509), and starting the alarm notification display unit and/or acoustic output unit to operate (511); otherwise, if determined to be NO, further determining whether the control button unit is pressed down;

(4) in case of determining the control button unit is pressed down, then similarly pushing the alarm notification signal to the portable alarm device (509); but, if determining the control button unit is not pressed down, then starting the alarm notification display unit and/or acoustic output unit to operate as well (511);

(5) subsequently, further determining whether the control button unit has been pressed down in hold for 2 seconds (512); if NO, then allowing the alarm notification display unit and/or acoustic output unit to continue their operations; if YES, stopping the operations of the alarm notification display unit and/or acoustic output unit (513); following this, returning to STEP (502);

(6) continued from STEP (507), if no system alarm notification is received, further determining whether the control button unit has been pressed down in hold for 2 seconds (514); if NO, returning to STEP (502); otherwise, if YES, enabling the alarm control unit to execute the system detection (515);

(7) then, determining whether the system operates normally (516); if determined to be abnormal, the system status display unit issues an abnormal indication (518), and the process returns to STEP (502); or, if determined to be normal, the system status display unit displays a normal indication (517), and then the process also returns to STEP (502) for repeated execution.

In comparison with other conventional technologies, the alarm notification system according to the present invention provides the following advantages:

(1) The present invention allows to set up an alarm central control device having the networking feature at home, which can receive signals coming from a sensor or a buzzer, and also transfer signals to a server appliance and then further to a portable alarm device by means of the external server, such that the user is capable of receiving alarm information and also pressing down the button on the portable alarm device thereby generating a signal to be sent back to the alarm central control device by way of the server appliance thus letting the alarm central device control the enabling operation of an anti-theft device.

(2) Moreover, seeing that the present invention applies LEDs or buzzers (speakers) to generate sound, the user can clearly receive and appreciate the alarm notification status and further send back the instructions in order to perform preliminary anti-theft or security procedures.

It should be noticed that, although the present invention has been disclosed through the detailed descriptions of the aforementioned embodiments, such illustrations are by no means used to restrict the scope of the present invention; that is, skilled ones in relevant fields of the present invention can certainly devise any applicable alternations and modifications after having comprehended the aforementioned technical characteristics and embodiments of the present invention without departing from the spirit and scope thereof. Hence, the scope of the present invention to be protected under patent laws should be delineated in accordance with the claims set forth hereunder in the present specification.

What is claimed is:

1. An alarm notification system, comprising:

a server appliance;

an alarm central control device, connected to the service appliance, one or more alarm detection devices and at least one anti-theft device, and including:

a central control controller unit, used to control the operation of the alarm central control device;

a network connection unit, electrically connected to the central control controller unit in order to connect to the Internet such that the central control controller unit can transfer an alarm notification signal to the server appliance, or receive a report control signal sent by the server appliance thus that the central control controller unit can control the operation of the anti-theft device based on the received report control signal;

an intelligent device, including:

a hotspot sharing unit, used to open and provide at least a Wi-Fi hotspot having a connection name and a connection password;

a pairing software, capable of connecting to the hotspot sharing unit so as to, after receiving a connection signal, send out the connection name and the connection password of the Wi-Fi hotspot;

a portable alarm device, including:

a power source voltage regulator unit, used to provide required electric power for the operation of the portable alarm device;

an alarm control unit, electrically connected to the power source voltage regulator unit so as to control the operation of the portable alarm device, and further allowing to detect the operation condition in the portable alarm device;

a pairing unit, electrically connected to the alarm control unit and the power source voltage regulator unit and capable of transferring the connection signal to be received by the pairing software in the intelligent device, such that the pairing software can further transfer the connection name and the connection password of the Wi-Fi hotspot to the pairing unit;

a wireless transmission unit, electrically connected to the alarm control unit and the power source voltage regulator unit and capable of enabling the wireless transmission function with the above-said connection name and connection password of the Wi-Fi hotspot thereby connecting to the Internet; also, the wireless transmission unit can receive the alarm notification signal transferred by the server appliance and then transfer to the alarm control unit in the portable alarm device, or alternatively, the alarm control unit in the portable alarm device can generate the report control signal which can be transferred to the server appliance by means of the wireless transmission unit;

a wireless status display unit, electrically connected to the alarm control unit and the power source voltage regulator unit for displaying the operation condition in the wireless transmission unit;

an alarm notification display unit, electrically connected to the alarm control unit and the power source voltage regulator unit and used for displaying after the alarm control unit receiving the alarm notification signal;

an acoustic output unit, electrically connected to the alarm control unit and the power source voltage regulator unit and used for generating the audio signal after the alarm control unit receiving the alarm notification signal;

a system status display unit, electrically connected to the alarm control unit and the power source voltage regulator unit and used for displaying the operation condition in the portable alarm device after the alarm control unit having detected the operation condition in the portable alarm device;

a reset button unit, electrically connected to the alarm control unit and the power source voltage regulator unit and used for pressing down thereby configuring the pairing connection with the portable alarm device; and one or more control button units, electrically connected to the alarm control unit and the power source voltage regulator unit and used for pressing down thereby controlling the operation of the alarm control unit.

2. The alarm notification system according to claim 1, wherein the alarm detection device is a siren or a sensor.

3. The alarm notification system according to claim 1, wherein the anti-theft device is a camera, a microphone and/or a remote alarm device.

4. The alarm notification system according to claim 1, wherein, after the reset button unit being pressed down, the alarm control unit controls the pairing unit to transfer the connection signal and receives the connection name and the connection password of the Wi-Fi hotspot such that the wireless transmission unit can start the wireless transmission function with the connection name and the connection password of the Wi-Fi hotspot and connect to the server appliance.

5. The alarm notification system according to claim 1, wherein the alarm control unit can set up the pressdown modes of the control button unit and control the operation of the alarm control unit in accordance with such different pressdown modes.

6. The alarm notification system according to claim 1, wherein the alarm control unit can be configured to, after receiving the alarm notification signal, automatically start the alarm notification display unit and/or the acoustic output unit.

7. The alarm notification system according to claim 1, wherein the alarm control unit can be configured such that, after receiving the alarm notification signal, the alarm control unit can start the alarm notification display unit and/or the acoustic output unit only when the control button unit is pressed down.

8. The alarm notification system according to claim 1, wherein the wireless status display unit, the alarm notification display unit and the system status display unit are Light-Emitting Diodes (LEDs).

9. The alarm notification system according to claim 1, wherein the acoustic output unit is a buzzer or a speaker.

10. The alarm notification system according to claim 1, wherein the power source voltage regulator unit can be a battery or a regulator circuit, and the regulator circuit can be further connected to an external power source.

* * * * *